US012104343B1

(12) United States Patent
Oh

(10) Patent No.: US 12,104,343 B1
(45) Date of Patent: Oct. 1, 2024

(54) THUMB PILE INCLUDING FITTING BRACKET AND METHOD FOR CONSTRUCTING STRUCTURE FOR TEMPORARY EARTH RETAINING

(71) Applicants: Yong Hwan Oh, Gyeonggi-do (KR); SINHWA PS E&C CO., LTD., Seoul (KR)

(72) Inventor: Yong Hwan Oh, Gyeonggi-do (KR)

(73) Assignees: Yong Hwan Oh, Gyeonggi-Do (KR); SINHWA PS E&C CO., LTD., Seoul (KR)

( * ) Notice: Subject to any disclaimer, the term of this patent is extended or adjusted under 35 U.S.C. 154(b) by 0 days.

(21) Appl. No.: 18/696,601

(22) PCT Filed: Dec. 22, 2023

(86) PCT No.: PCT/KR2023/021359
§ 371 (c)(1),
(2) Date: Mar. 28, 2024

(30) Foreign Application Priority Data

Jun. 27, 2023 (KR) ..... 10-2023-0082371

(51) Int. Cl.
*E02D 17/04* (2006.01)
*E02D 17/08* (2006.01)

(52) U.S. Cl.
CPC ..... *E02D 17/04* (2013.01); *E02D 17/08* (2013.01)

(58) Field of Classification Search
CPC . E02D 17/04; E02D 17/08; E02D 2250/0046; E01D 2101/285
See application file for complete search history.

(56) References Cited

FOREIGN PATENT DOCUMENTS

| | | | |
|---|---|---|---|
| KR | 10-2019-0036591 | A | 4/2019 |
| KR | 10-2127072 | B1 | 6/2020 |
| KR | 10-2162467 | B1 | 10/2020 |
| KR | 102456100 | * | 10/2022 |
| KR | 20230065592 | * | 5/2023 |

* cited by examiner

*Primary Examiner* — Carib A Oquendo
(74) *Attorney, Agent, or Firm* — The PL Law Group, PLLC

(57) ABSTRACT

A thumb pile provided with a fitting bracket improves work convenience by tensioning a tensile member while inserting a bracket constituted by a plurality of bracket members manufactured using a shearing method into a flange, and at the same time, more efficiently reduce bending stress occurring in a retaining wall through the improved bracket structure.

10 Claims, 10 Drawing Sheets

THUMB PILE INCLUDING FITTING BRACKET AND METHOD FOR CONSTRUCTING STRUCTURE FOR TEMPORARY EARTH RETAINING

CROSS REFERENCE TO RELATED APPLICATION AND CLAIM OF PRIORITY

This application claims benefit under 35 U.S.C. 119, 120, 121, or 365 (c), and is a National Stage entry from International Application No. PCT/KR2023/021359, filed Dec. 22, 2023 which claims priority to the benefit of Korean Patent Application No. 10-2023-0082371 filed in the Korean Intellectual Property Office on Jun. 27, 2023, the entire contents of which are incorporated herein by reference.

BACKGROUND

1. Technical Field

The present invention relates to a thumb pile having a fitting bracket and a method for constructing a structure for a temporary earth retaining using the same, and more particularly, to an improved self-supporting earth retaining technology that involves tensioning tensile members in a state in which a bracket constituted by a plurality of bracket members manufactured by a shearing method is inserted into a flange, instead of a conventional bolt coupling type bracket.

2. Background Art

Generally, at civil engineering or building construction sites, temporary earth-retaining structures are installed to prevent soil disposed at a rear side of excavated soil (i.e., backfill soil) from being introduced into the soil to be excavated (i.e., excavated soil). The temporary earth-retaining structures may be made of thumb piles, earthen plates, wales, struts, etc., and prevent a space to be excavated from collapsing due to an earth pressure of the backfill soil.

In this regard, Korean Patent Registration No. 10-2162467 that is a prior art document discloses a thumb pile in which prestress is introduced and a self-supporting temporary earth retaining construction method using the same. However, in the case of the self-supporting temporary earth retaining construction method according to Korean Patent Registration No. 10-2162467, there are problems in that convenience of a work and construction and a tensile effect of a tensile member are poor. Specifically, in the case of the self-supporting temporary earth retaining construction method according to Korean Patent Registration No. 10-2162467, it is inconvenient to form a separate insertion groove 234 in a hanging plate 230 of hanging brackets 200*a* and 200*b*. In addition, as an inner structure of each of the hanging brackets 200*a* and 200*b* is complex, it takes a lot of time and money to manufacture the hanging brackets 200*a* and 20*b*. In addition, due to the structural limitations of the upper hanging bracket 200*a*, an eccentric distance in the upper hanging bracket 200*a* is small, and thus, there is a problem that a tensioning effect by a tensile member 300 is not large.

SUMMARY

The present invention is provided to improve work convenience by tensioning a tensile member while inserting a bracket constituted by a plurality of bracket members manufactured using a shearing method into a flange, and at the same time, more efficiently reduce bending stress occurring in a retaining wall through the improved bracket structure.

According to the present invention, a thumb pile provided with a fitting bracket includes: a beam member (110) constituted by a web (102) and a first flange (104*a*) and a second flange (104*b*), which are perpendicularly coupled to the web (102) on both sides of the web (102); an upper bracket (120) fitted into the first flange (104*a*) at an upper portion of the beam member (110); a lower bracket (130) that faces the upper bracket (120) at a lower portion of the beam member (110) and is fitted into the first flange (104*a*); and a plurality of tensile members (140) extending in a longitudinal direction of the beam member (110) between the upper bracket (120) and the lower bracket (130) and fixedly installed on the upper bracket (120) and the lower bracket (130), respectively, wherein the upper bracket (120) is constituted by a first bracket member (120*a*) and a second bracket member (120*b*), which face each other with respect to the web (102) at the upper portion of the first flange (104*a*) and are spaced a predetermined distance from each other, each of the first bracket member (120*a*) and the second bracket member (120*b*) includes: a vertical plate (202) extending from a front surface of the first flange (104*a*) by a predetermined length in the longitudinal direction of the beam member (110); a horizontal plate (204) formed by being bent vertically from one end of the vertical plate (202); and a hanging plate (206) disposed on a rear surface of the first flange (104*a*) by being vertically bent from one end of the horizontal plate (204), a first groove (204*a*) is defined at an edge of the other end of the horizontal plate (204) of the first bracket member (120*a*), a second groove (204*b*) is defined at an edge of the other end of the horizontal plate (204) of the second bracket member (120*b*), the first groove (204*a*) and the second groove (204*b*) are disposed to face each other to define a hollow (P) having a predetermined size, at which the plurality of tensile members (140) pass, between an inner surface of the first groove (204*a*) and an inner surface of the second groove (204*b*), and an anchoring member (208) for anchoring the plurality of tensile members (140) is seated on an upper portion of the horizontal plate (204) corresponding to the hollow (P).

The other end of the horizontal plate (204) may be provided to protrude by a predetermined length in a direction vertically away from the front surface of the first flange (104*a*) and have a curvature having a shape in which a protruding length from the front surface of the first flange (104*a*) to the other end of the horizontal plate (204) becomes smaller as it goes from a central portion of the first flange (104*a*) to the outside of the first flange (104*a*).

The first groove (204*a*) and the second groove (204*b*) may be defined in the edge of the other end of the horizontal plate (204) having the longest protruding length.

A reinforcing member (210) vertically protruding from the vertical plate (202) toward the other end of the horizontal plate (204) to support the other end of the horizontal plate (204) may be provided at a lower portion of the other end of the horizontal plate (204), and a protruding length of the reinforcing member (210) vertically protruding from the vertical plate 202 may become smaller as the reinforcing member (210) moves away from the horizontal plate (204).

A distance (d) between the first bracket member (120*a*) and the second bracket member (120*b*) may be equal to or greater than a thickness of a web (102) so as not to interfere with the web (102) when the first bracket member (120*a*) and the second bracket member (120*b*) are fitted into the first flange (104*a*).

A connection member (212) having a bar shape to fix the first bracket member (120*a*) and the second bracket member (120*b*) to each other may be provided between the first bracket member (120*a*) and the second bracket member (120*b*).

The anchoring member (208) may be seated on the upper portion of the horizontal plate (204) while covering the hollow (P) and has a plurality of anchoring holes (208*a*) through which the plurality of tensile members (140) pass to be anchored.

The lower bracket (130) may be constituted by a first bracket member (130*a*) and a second bracket member (130*b*), which face each other with respect to the web (102) at the lower portion of the first flange (104*a*) and are spaced a predetermined distance from each other, each of the first bracket member (130*a*) and the second bracket member (130*b*) may include: a vertical plate (302) extending from a front of the first flange (104*a*) by a predetermined length in the longitudinal direction of the beam member (110); a horizontal plate (304) formed by being bent vertically from one end of the vertical plate (302); and a hanging plate (306) disposed on a rear surface of the first flange (104*a*) by being vertically bent from one end of the horizontal plate (304), and a plurality of through-holes (304*a*) through which the plurality of tensile members (140) pass may be defined to be spaced a predetermined interval from each other in the horizontal plate (304).

A separation prevention member (304*b*) that supports the plurality of tensile members (140) to prevent the plurality of tensile members (140) from being separated to the outside of the lower bracket (130) may be provided in plurality to be parallel to the plurality of tensile members (140) outside of the horizontal plate (304), and the plurality of separation prevention members (304*b*) may be adjacent to the plurality of through-holes (304*a*) and are provided perpendicular to the horizontal plate (304).

According to the present invention, a method for constructing a structure for a temporary earth retaining by using the thumb pile (100) includes: manufacturing a thumb pile (100); tensioning a plurality of tensile members (140) installed on the thumb pile (100) to a first size; forming a drill hole (H) by excavating ground (G) to a predetermined diameter and depth; inserting the thumb pile (100) with prestress introduced into the drill hole (H); and tensioning the plurality of tensile members (140) to a second size greater than the first size while the thumb pile (100) is restricted by water compaction or soil.

According to the present invention, the plurality of tensile members 140 may be fixed and installed using the upper bracket 120 and the lower bracket 130, which are constituted by the two bracket members with the symmetrical structure manufactured by the shearing method to improve the convenience of work and also more efficiently reduce the bending stress occurring in the retaining wall through the improved bracket structure. The upper bracket 120 and the lower bracket 130 of the present invention may be fitted into the upper and lower portions of the first flange 104*a*, respectively, while opposing each other, and thus the separate bolt coupling may not be necessary.

In addition, the distance d between the first bracket member 120*a* and the second bracket member 120*b* and the distance d between the first bracket member 130*a* and the second bracket member 130*b* may be equal to or greater than the thickness of the web 102 during the manufacturing process through the shearing, and thus, there may be no need to form the separate insertion groove at one side to prevent the interference with the web 102.

As described above, the structure of the upper bracket 120 and the lower bracket 130 of the present invention may have the superior advantages in terms of convenience of the work and construction, the consumed costs, and the tensile effect compared to the conventional thumb piles or the temporary earth retaining facilities.

DETAILED DESCRIPTION

Hereinafter, embodiments of the present invention will be described in detail with reference to the accompanying drawings. The following detailed descriptions are provided to help comprehensive understanding of a method, an apparatus, and/or a system described in this specification. However, this is merely an example, and the present invention is not limited thereto.

In descriptions of embodiments of the present invention, detailed descriptions related to the well-known technologies will be ruled out in order not to unnecessarily obscure subject matters of the present invention. Also, terms used in the present specification are terms defined in consideration of functions according to embodiments, and thus the terms may be changed according to the intension or usage of a user or operator. Therefore, the terms should be defined on the basis of the overall contents of this specification. The terms used in the present specification are merely used to describe particular embodiments, and are not intended to limit the present invention. An expression used in the singular encompasses the expression in the plural, unless it has a clearly different meaning in the context. In the present specification, it is to be understood that terms such as "including" or "having", etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Figure 1:
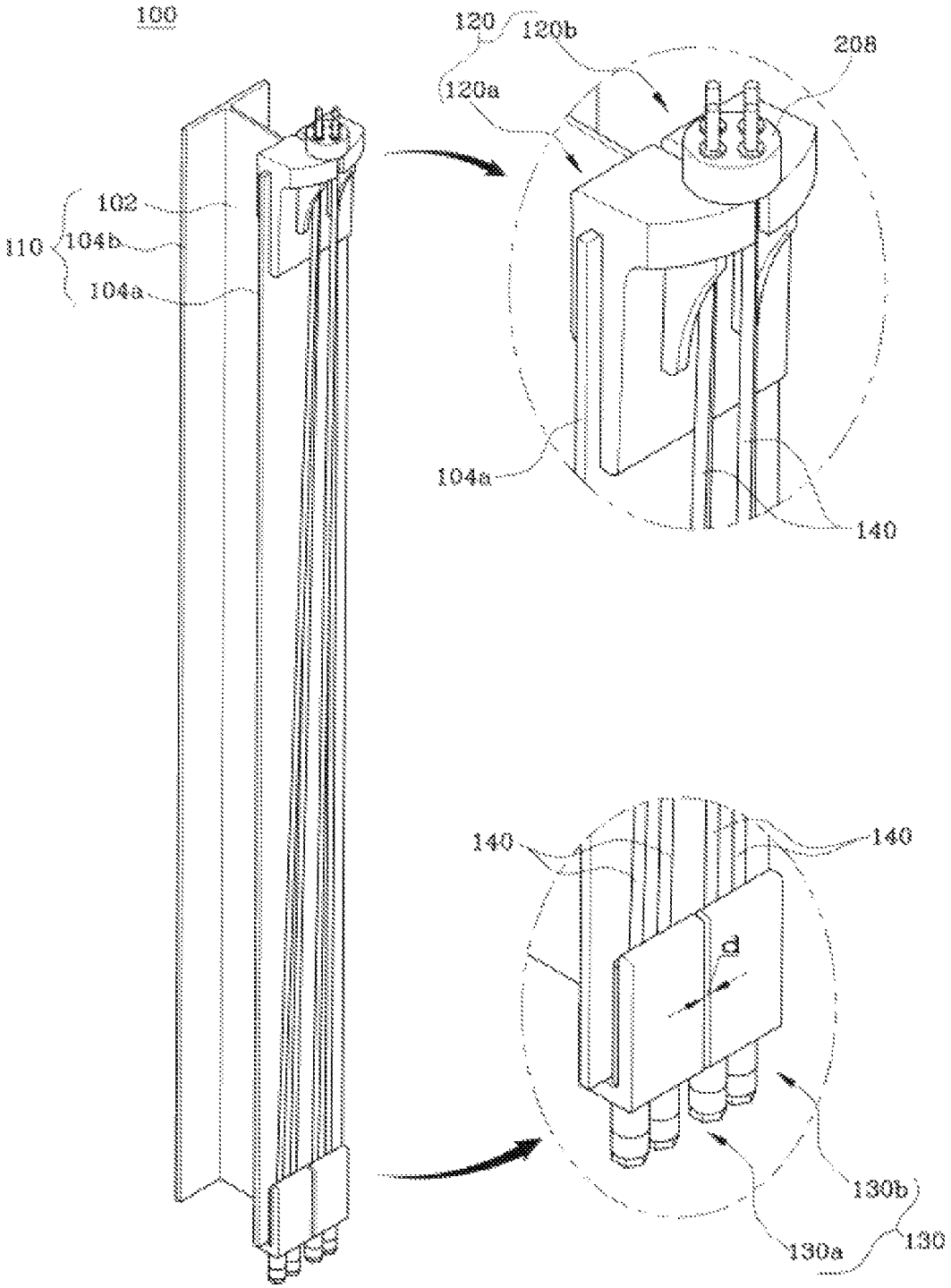
FIG. 1 is a perspective view of a thumb pile according to an embodiment of the present invention.

FIG. 1 is a perspective view of a thumb pile 100 according to an embodiment of the present invention. As illustrated in FIG. 1, the thumb pile 100 according to an embodiment of the present invention includes a beam member 110, an upper bracket 120, a lower bracket 130, and a plurality of tensile members 140, and prestress is introduced to reduce bending stress generated in a self-supporting retaining wall.

The beam member 110 may be provided as an H beam having a certain length and may be constituted by a web 102 and a first flange 104*a* and a second flange 104*b*, which are vertically coupled to the web 102 at both sides of the web 102. Here, it is assumed that the first flange 104*a* is a flange facing a backfill soil side, and the second flange 104*b* is a flange facing an excavated soil side.

The upper bracket 120 is fitted into the first flange 104*a* from an upper side of the beam member 110.

The lower bracket 130 is fitted to the first flange 104*a* while opposing the upper bracket 120 at a lower portion of the beam member 110.

The tensile member 140 extends along a longitudinal direction of the beam member 110 between the upper bracket 120 and the lower bracket 130 and is fixedly installed on each of the upper bracket 120 and the lower bracket 130. As an example, four tensile members 140 extend along the longitudinal direction of the beam member 110 between the upper bracket 120 and the lower bracket 130 and are fixedly installed on each of the upper bracket 120 and the lower bracket 130.

Here, the upper bracket 120 and the lower bracket 130 may be fitted into the upper and lower portions of the first flange 104*a*, respectively, while opposing each other, and thus the separate bolt coupling may not be necessary.

In addition, the upper bracket 120 may be constituted by a first bracket member 120*a* and a second bracket member 120*b*, which face each other with respect to the web 102 at an upper portion of the first flange 104*a* and are spaced a predetermined distance from each other. Here, the upper bracket 120 is manufactured by shearing a single metal material, and thus, the first bracket member 120*a* and the second bracket member 120*b* having symmetrical shapes may be provided. As will be described later, a structure of the upper bracket 120 according to this embodiment, which is constituted by the two bracket members 120*a* and 120*b*, increases in eccentric distance of the tensile member 140 in the upper bracket 120 to reduce bending stress generated in the retaining wall, thereby generating a moment in an opposite direction.

In addition, the upper bracket 120 manufactured using the shearing method does not include a separate welded portion, and thus, it is sufficiently withstand the generated moment. In addition, the lower bracket 130 may be constituted by a first bracket member 130*a* and a second bracket member 130*b*, which face each other with respect to the web 102 at a lower portion of the first flange 104*a* and are spaced a predetermined distance from each other. Here, the lower bracket 130 is manufactured by shearing a single metal material like the upper bracket 120, and thus, the first bracket member 130*a* and the second bracket member 130*b* having symmetrical shapes may be provided. As will be described later, the structure of the lower bracket 130 of the present embodiment, which is constituted by the two bracket members 130*a* and 130*b*, may be advantageous for fixing and installing a plurality of tensile members 140, and is especially may accommodate a large number of tensile members 140 while having a structure that is more simplified than the conventional lower bracket.

As illustrated in FIG. 1, the upper bracket 120 is configured to protrude more in a vertical direction from the first flange 104*a* than the lower bracket 130, which secures the eccentric distance from the upper bracket 120 described above. If the lower bracket 130 is designed with the same configuration and shape as the upper bracket 120, a drill diameter becomes larger, and thus, drill costs becomes very large. Thus, it is desired that the configurations and shapes of the upper bracket 120 and the lower bracket 130 are different from each other.

Hereinafter, the detailed configuration of the upper bracket 120 and lower bracket 130 will be described in more detail with reference to FIGS. 2 to 8.

Figure 2:
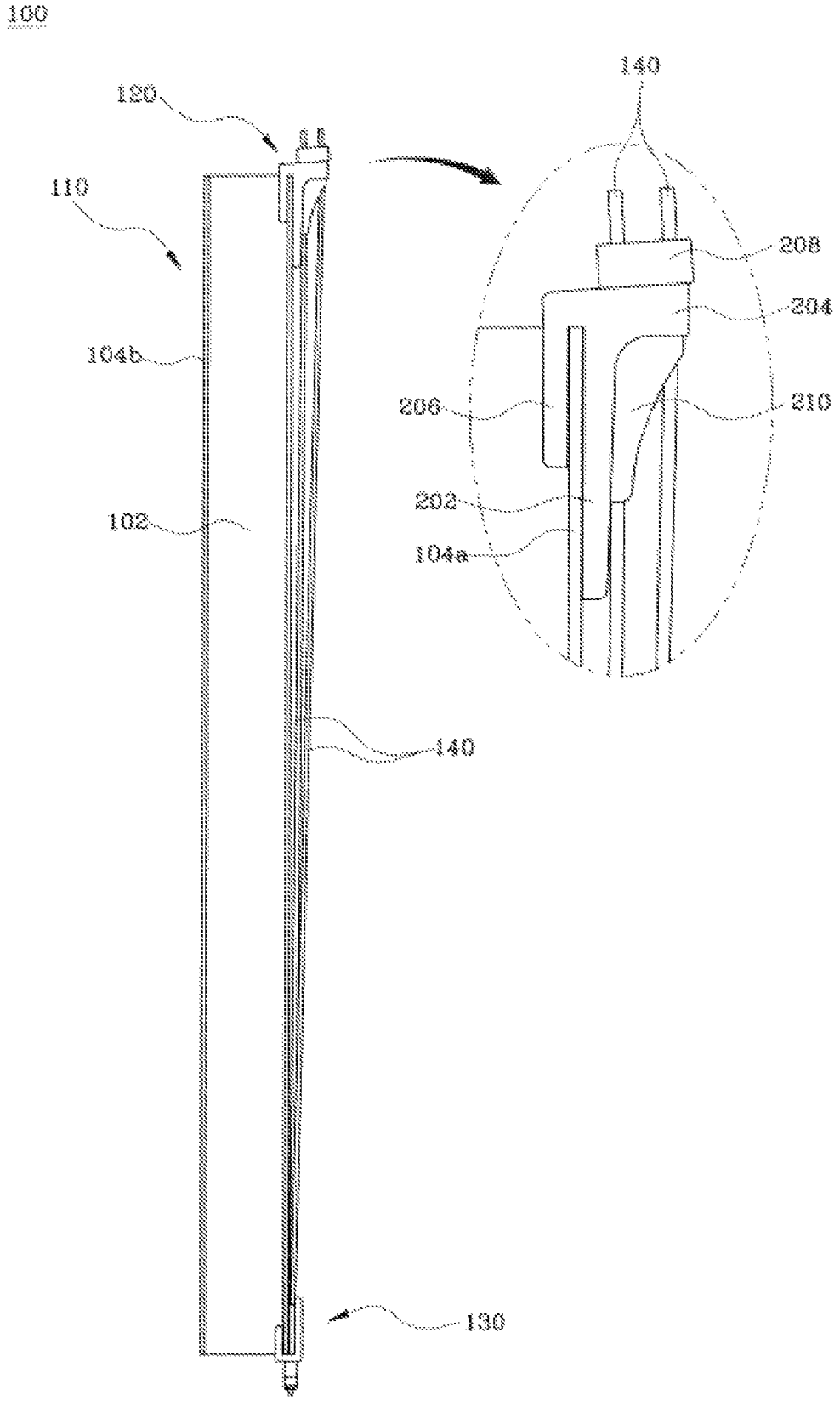
FIG. 2 is a side view of the thumb pile and an upper bracket according to an embodiment of the present invention.
Figure 3:
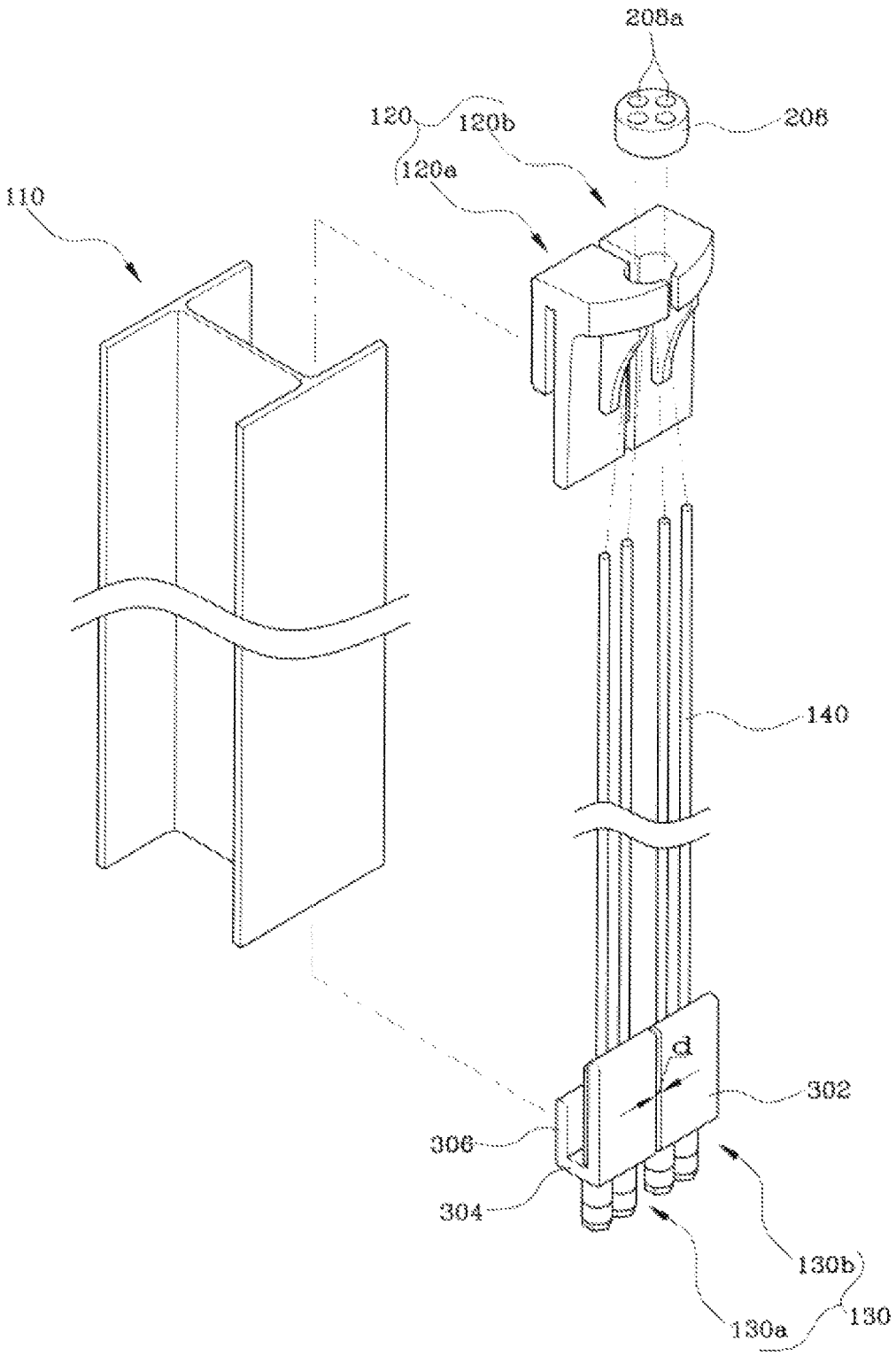
FIG. 3 is a view for explaining the upper bracket and a lower bracket according to an embodiment of the present invention.
Figure 4:
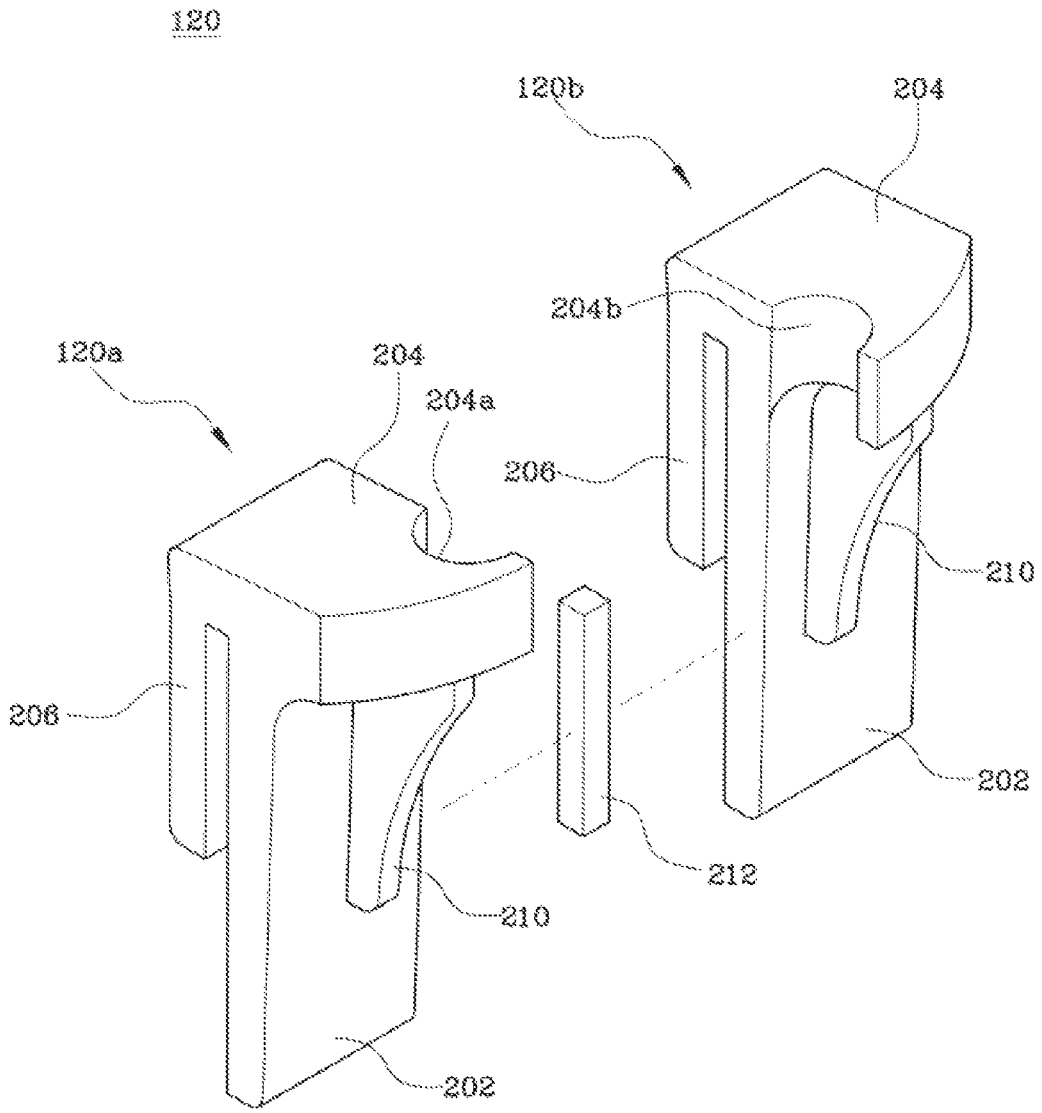
FIG. 4 is a view illustrating a detailed configuration of the upper bracket according to an embodiment of the present invention.
Figure 5:
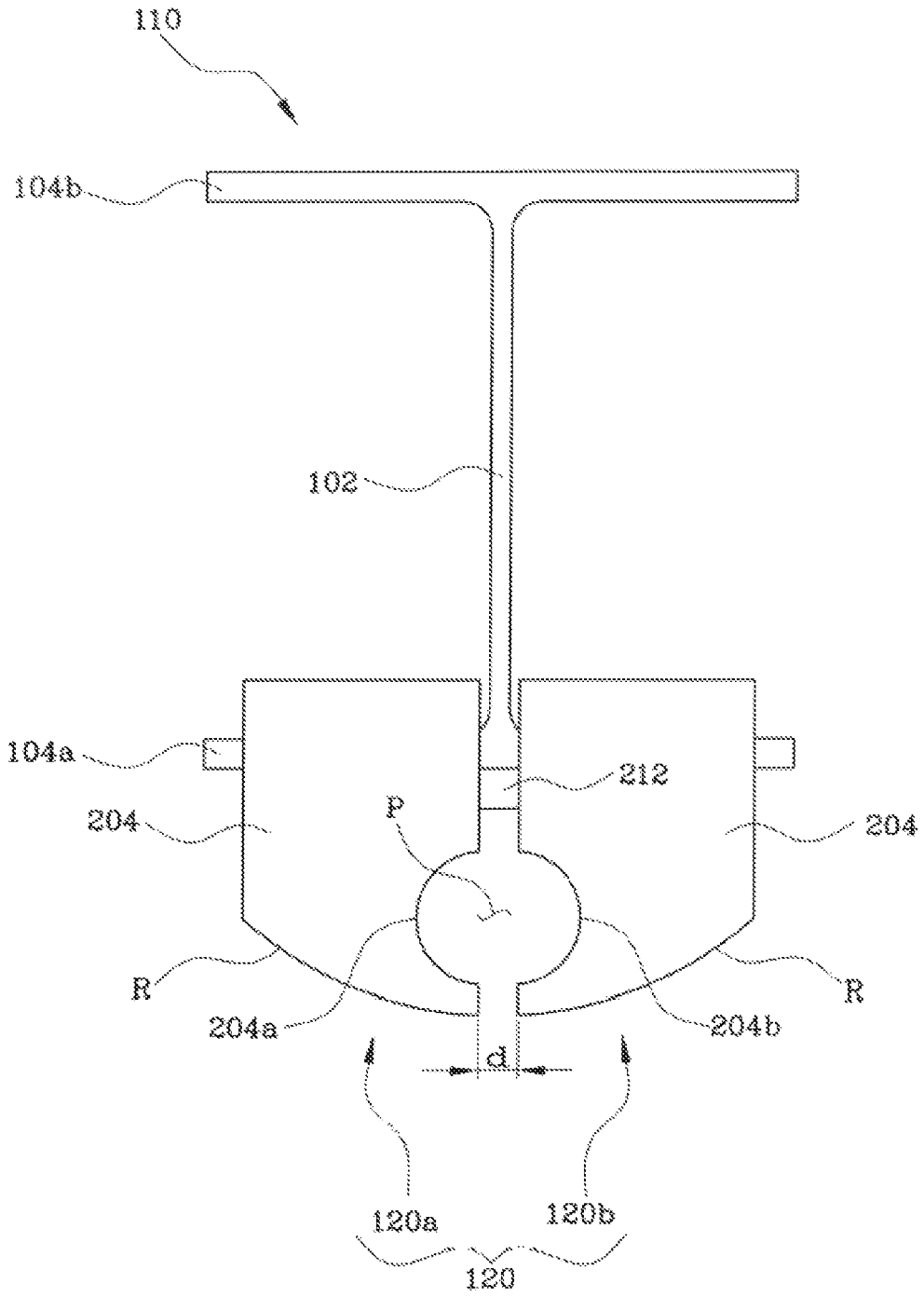
FIG. 5 is a view of the upper bracket when viewed from the above according to an embodiment of the present invention.
Figure 6:
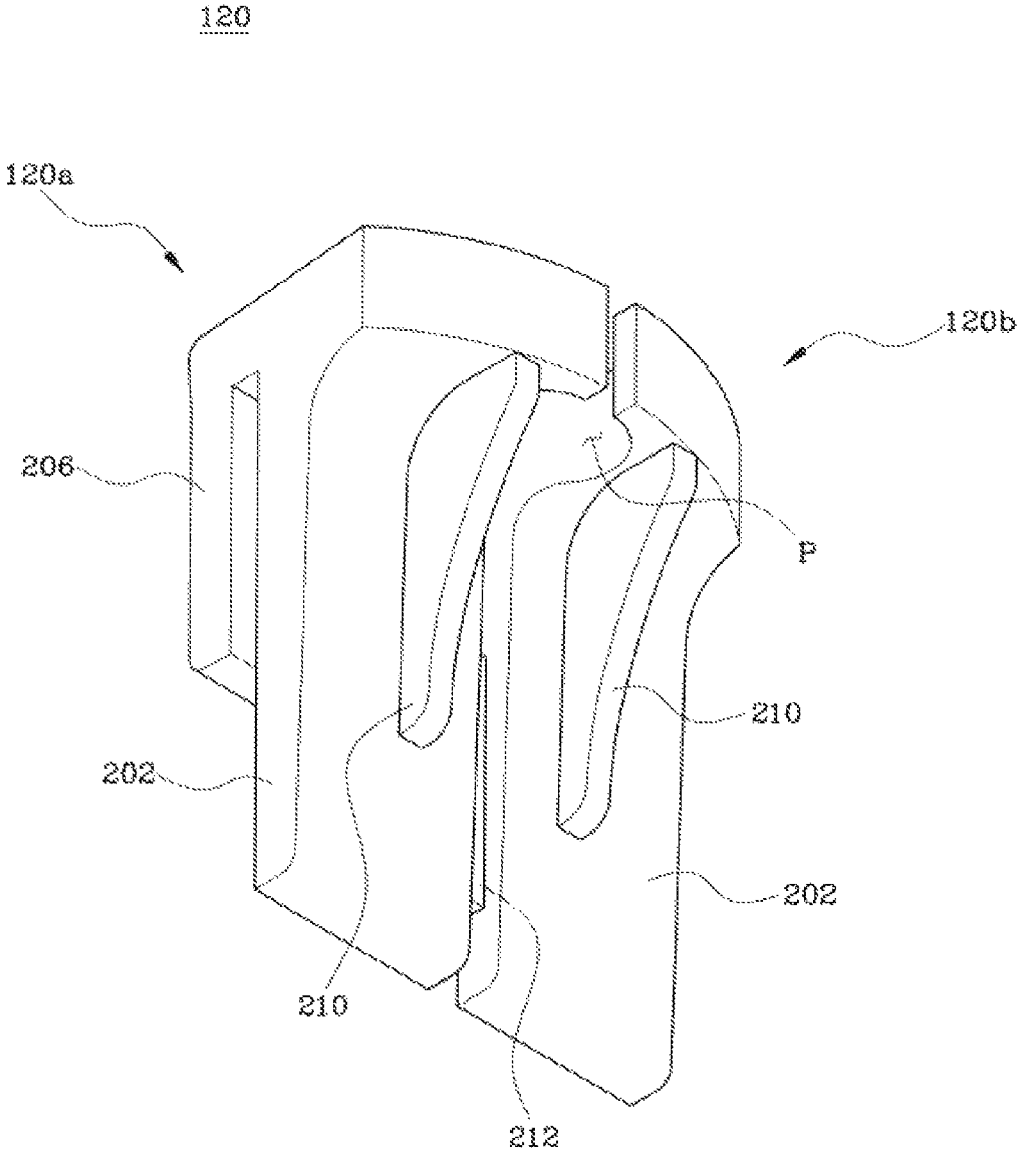
FIG. 6 is a view of the upper bracket when viewed from the below according to an embodiment of the present invention.
Figure 7:
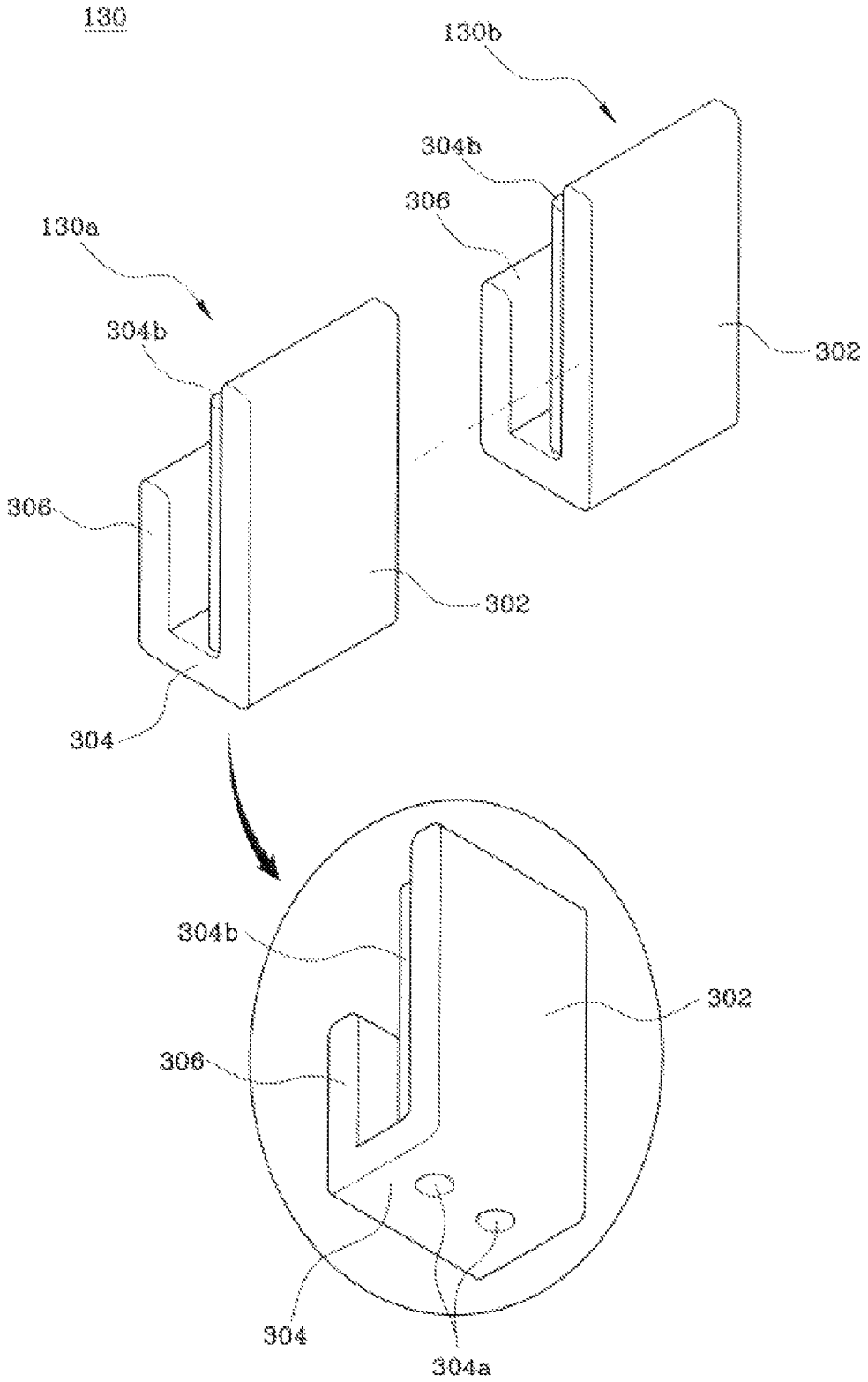
FIG. 7 is a view illustrating a detailed configuration of the lower bracket according to an embodiment of the present invention.
Figure 8:
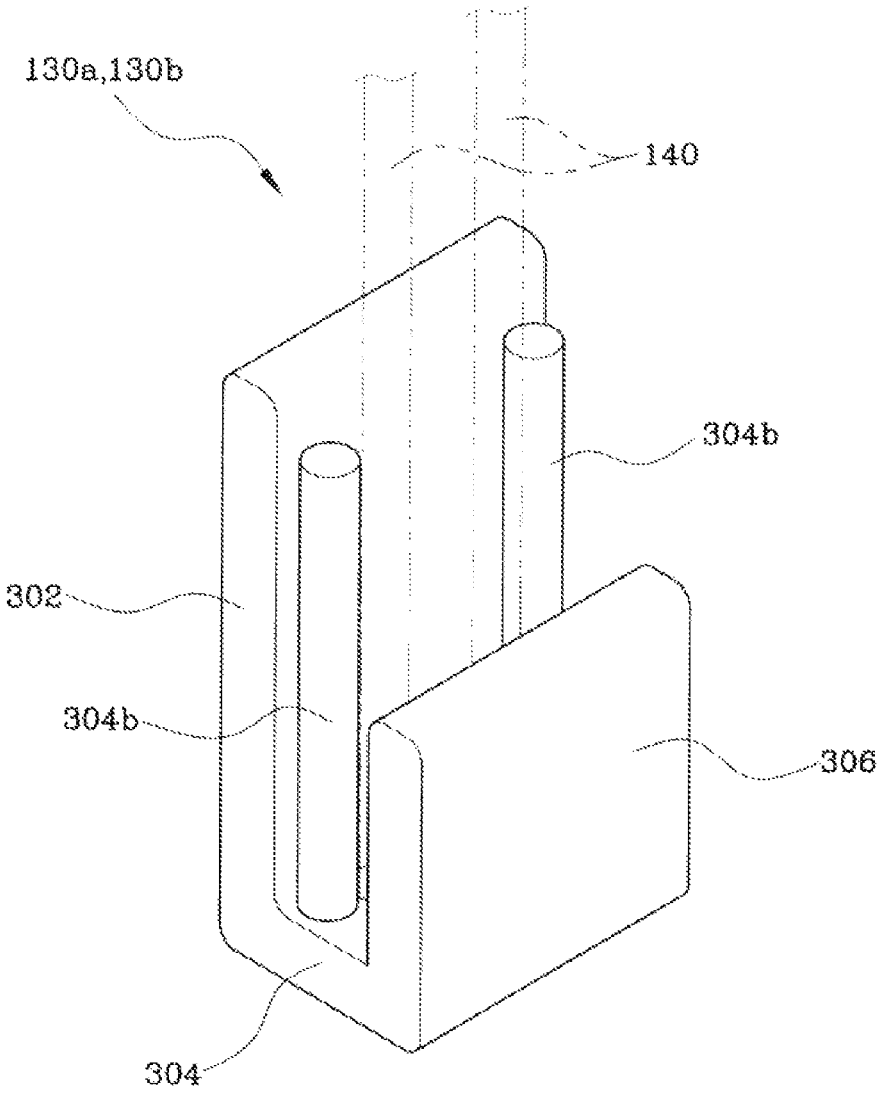
FIG. 8 is a view illustrating an example of a separation prevention member of the lower bracket according to an embodiment of the present invention.
Figure 9:
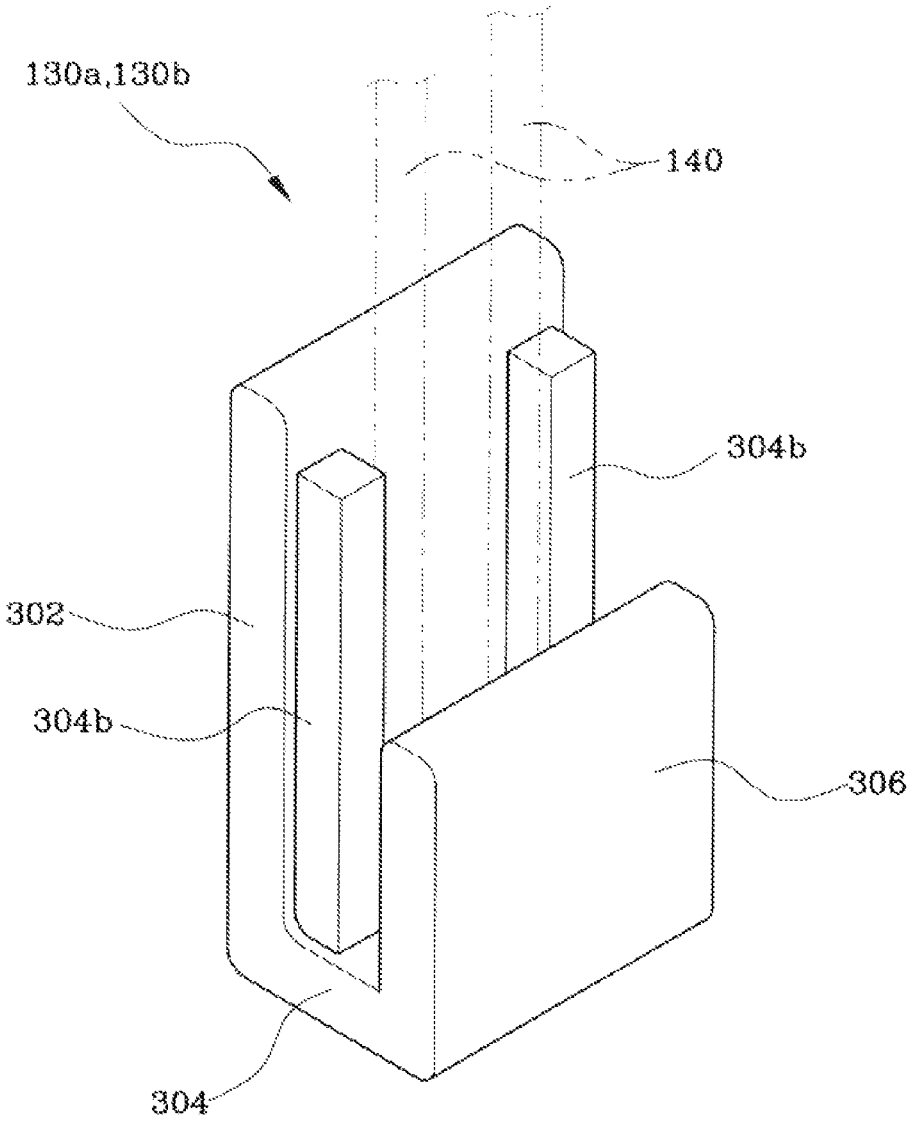
FIG. 9 is a view illustrating an example of a separation prevention member of the lower bracket according to another embodiment of the present invention.
Figure 10:
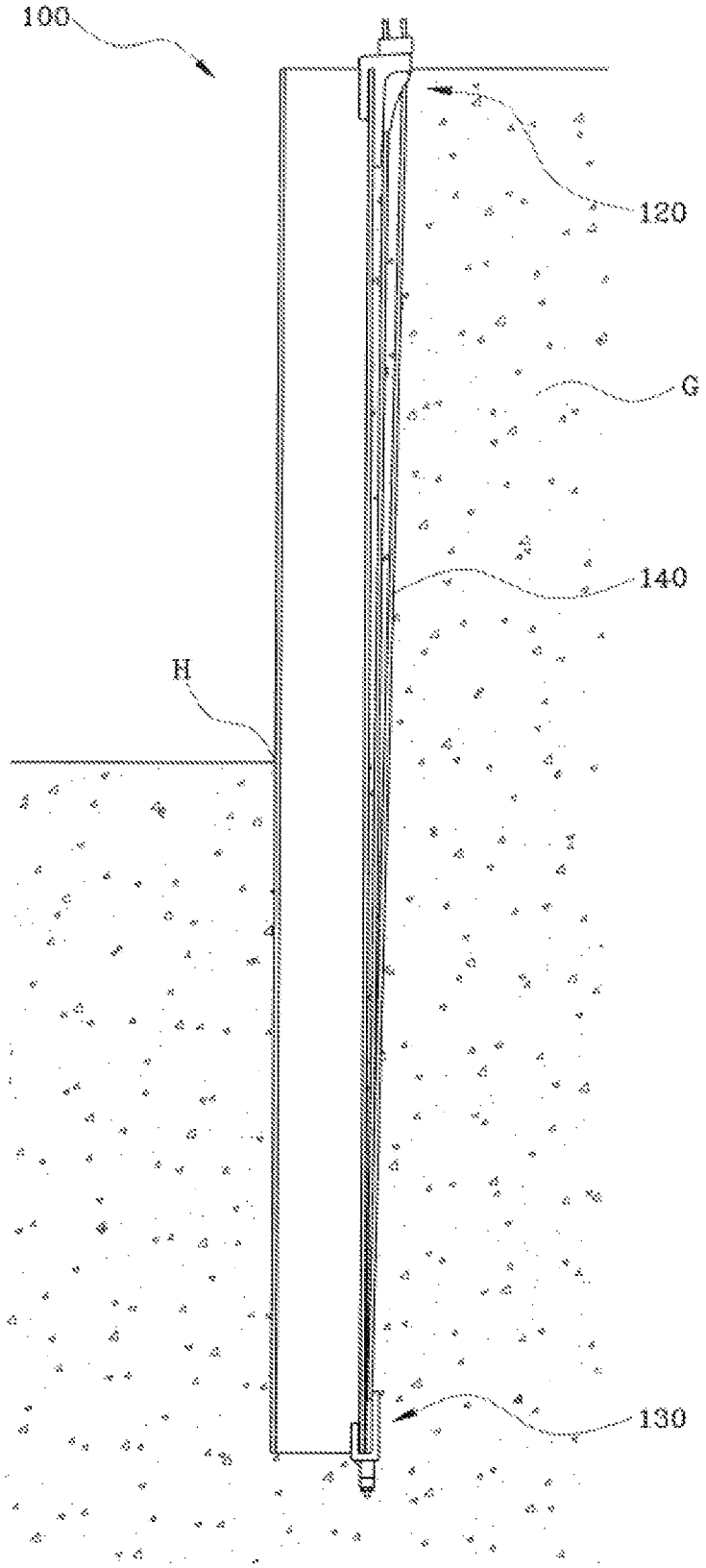
FIG. 10 is a view illustrating an example in which the thumb pile is installed according to an embodiment of the present invention.

FIG. 2 is a side view of the thumb pile 100 and the upper bracket 120 according to an embodiment of the present invention, and FIG. 3 is a view for explaining the upper bracket 120 and the lower bracket 130 according to an embodiment of the present invention. In addition, FIG. 4 is a view illustrating a detailed configuration of the upper bracket 120 according to an embodiment of the present invention, FIG. 5 is a view of the upper bracket 120 when viewed from the above according to an embodiment of the present invention, and FIG. 6 is a view of the upper bracket 120 when viewed from the below according to an embodiment of the present invention. In addition, FIG. 7 is a view illustrating a detailed configuration of the lower bracket 130 according to an embodiment of the present invention, FIG. 8 is a view illustrating an example of a separation prevention member 304*b* of the lower bracket 130 according to an embodiment of the present invention, and FIG. 9 is a view illustrating an example of a separation prevention member 304*b* of the lower bracket 130 according to another embodiment of the present invention.

As described above, the upper bracket 120 may be constituted by a first bracket member 120*a* and a second bracket member 120*b*. Each of the first bracket member 120*a* and the second bracket member 120*b* may be constituted by a vertical plate 202, a horizontal plate 204, a hanging plate 206, and an anchoring member 208.

The vertical plate 202 extends by a predetermined length from a front surface of the first flange 104*a* along the longitudinal direction of the beam member 110. The vertical plate 202 may have a rectangular shape with a predetermined thickness and width.

The horizontal plate 204 is formed by being bent vertically from one end of the vertical plate 202.

The hanging plate 206 is vertically bent from one end of the horizontal plate 204 and is provided on a rear surface of the first flange 104*a*.

The vertical plate 202, the horizontal plate 204, and the hanging plate 206 form a L-shaped structure, and an end of the first flange 104*a* is inserted and fitted into the C-shaped structure formed in this manner.

In addition, grooves 204*a* and 204*b* through which the plurality of tensile members 140 pass may be defined in an edge of the other side of the horizontal plate 204. Each of the grooves 204*a* and 204*b* may have, for example, a semicircular shape.

Referring to FIGS. 3 to 6, the first groove 204*a* of the first bracket member 120*a* and the second groove 204*b* of the second bracket member 120*b* may be disposed to face each other and thus provide a hollow P having a predetermined size so that the plurality of tensile members 140 pass between an inner surface of the first groove 204*a* and an inner surface of the second groove 204*b*.

The anchoring member 208 is a member for anchoring the plurality of tensile members 140 and is seated on an upper portion of the horizontal plate 204 corresponding to the hollow P. The anchoring member 208 may have a shape corresponding to the hollow P and have a cross-section greater than that of the hollow P. The anchoring member 208 is seated on the upper portion of the horizontal plate 204 while covering the hollow P and has a plurality of anchoring holes 208*a* through which the plurality of tensile members 140 pass to be anchored. The anchoring member 208 may include, for example, four anchoring holes 208*a* spaced a predetermined distance from each other. Thus, the plurality of tensile members 140 may sequentially pass through the hollow P and the anchoring hole 208*a*.

Here, the other end of the horizontal plate 204 may be provided to protrude by a predetermined length in a direction vertically away from the front surface of the first flange 104*a* and may have a curvature having a shape R in which a protruding length from the front surface of the first flange 104*a* to the other end of the horizontal plate 204 becomes smaller as it goes from a central portion of the first flange 104*a* to the outside of the first flange 104*a*. As illustrated in FIG. 5, the other end of the horizontal plate 204 may have a curved shape R. Here, each of the grooves 204*a* and 204*b* may be defined in the edge of the other end of the horizontal plate 204 with the longest protruding length. That is, the grooves 204*a* and 204*b* may be defined at a point that is furthest from the front surface of the first flange 104*a* on a top surface of the horizontal plate 204. As described above, since the plurality of tensile members 140 pass through the grooves 204*a* and 204*b* and are anchored by the anchoring member 208, when the grooves 204*a* and 204*b* are defined at the point that is furthest from the front surface of the first flange 104*a*. the eccentric distance at the upper bracket 120 may be maximized. Thus, the plurality of tensile members 140 are tensioned in a state of being farther away from the front surface of the first flange 104*a* at a position of the upper bracket 130 than at a position of the lower bracket 120, and thus, a moment in the opposite direction to the bending stress generated in the retaining wall may be generated.

In addition, a reinforcing member 210 that protrudes vertically from the vertical plate 202 to the other end of the horizontal plate 204 to support the other end of the horizontal plate 204 may be provided at a lower portion of the other end of the horizontal plate 204. Here, a protruding length of the reinforcing member 210 vertically protruding from the vertical plate 202 may become smaller as the reinforcing member 210 moves away from the horizontal plate 204.

In addition, a distance d between the first bracket member 120*a* and the second bracket member 120*b* may be equal to or greater than a thickness of the web 102 so as not to interfere with the web 102 when the first bracket member 120*a* and the second bracket member 120*b* are fitted into the first flange 104*a*. Thus, in the process of fitting the first bracket member 120*a* and the second bracket member 120*b* into the first flange 104*a*, the web 102 and the distance d may correspond to each other, and thus, the first bracket member 120*a* and the second bracket member 120*b* may not interfere with the web 102.

In addition, a connection member 212 having a bar shape to fix the first bracket member 120*a* and the second bracket member 120*b* to each other may be provided between the first bracket member 120*a* and the second bracket member 120*b*. The connection member 212 is a means for connecting and fixing the first bracket member 120*a* and the second bracket member 120*b* to each other and may be provided to extend along the longitudinal direction of the beam member 110. The connection member 212 together with the previously described reinforcing member 210 may further improves strength and stability of the upper bracket 120.

Next, the lower bracket 130 may be constituted by a first bracket member 130*a* and a second bracket member 130*b*. Each of the first bracket member 130*a* and the second bracket member 130*b* may be constituted by a vertical plate 302, a horizontal plate 304, and a hanging plate 306.

The vertical plate 302 extends by a predetermined length from a front surface of the first flange 104*a* along the longitudinal direction of the beam member 110. The vertical plate 302 may have a rectangular shape with a predetermined thickness and width.

The horizontal plate 304 is formed by being bent vertically from one end of the vertical plate 302.

The hanging plate 306 is vertically bent from one end of the horizontal plate 304 and is provided on a rear surface of the first flange 104*a*.

The vertical plate 302, the horizontal plate 304, and the hanging plate 306 form a L-shaped structure, and an end of the first flange 104*a* is inserted and fitted into the C-shaped structure formed in this manner. Here, unlike the horizontal plate 204 of the upper bracket 120, the horizontal plate 304 does not have the separate grooves, the protrusions, or the ends having the curved structure. Instead, a plurality of through-holes 304*a* for allowing the plurality of tensile members 140 to pass therethrough may be defined in the horizontal plate 304 at predetermined intervals.

Here, a separation prevention member 304*b* that supports the plurality of tensile members 140 to prevent the plurality of tensile members 140 from being separated to the outside of the lower bracket 130 may be provided in plurality to be parallel to the plurality of tensile members 140 outside the horizontal plate 304. The separation prevention member 304*b* may be provided perpendicular to the horizontal plate 304 while adjacent to the plurality of through-holes 304*a*. As illustrated in FIGS. 7 and 8, the separation prevention member 304*b* may be provided on each of both surfaces of the first bracket member 130*a*, and the separation prevention member 304*b* may be provided on each of both surfaces of the second bracket member 130*b*. The tensile member 140 may be disposed adjacent to the separation prevention member 304*b* inside the separation prevention member 304*b*. Here, the separation prevention member 304*b* may be provided, for example, in a cylindrical shape with a circular cross-section. However, the shape of the separation prevention member 304*b* is not limited thereto, and the separation prevention member 304*b* may be provided in the shape of a bar with a square cross-section, as illustrated in FIG. 9.

In addition, a distance d between the first bracket member 130*a* and the second bracket member 130*b* may be equal to or greater than a thickness of the web 102 so as not to interfere with the web 102 when the first bracket member 130*a* and the second bracket member 130*b* are fitted into the first flange 104*a*. Thus, in the process of fitting the first bracket member 130*a* and the second bracket member 130*b* into the first flange 104*a*, the web 102 and the distance d may correspond to each other, and thus, the first bracket member 130*a* and the second bracket member 130*b* may not interfere with the web 102.

The distance d between the first bracket member 120*a* and the second bracket member 120*b* and the distance d between the first bracket member 130*a* and the second bracket member 130*b* may be equal to or greater than the thickness of the web 102 during the manufacturing process through the shearing, and thus, there may be no need to form the separate insertion groove at one side to prevent the interference with the web 102. In addition, both the upper bracket 120 and the lower bracket 130 may be provided as two bracket members with a symmetrical structure, and thus, a large number of tensile members 140 may be fixed and installed to further improve tension force.

FIG. 9 is a view illustrating an example in which the thumb pile 100 is installed according to an embodiment of the present invention.

Referring to FIG. 9, a method for constructing a temporary earth retaining structure using the thumb piles 100 may be performed through the following steps.

1. Step of manufacturing thumb pile (100)

As described above, the thumb pile 100 is manufactured by manufacturing the upper bracket 120 and the lower bracket 130 and then fitting the upper bracket 120 and the lower bracket 130 into the upper and lower portions of the first flange 104*a*, respectively.

2. Step of tensioning plurality of tensile members 140 installed on thumb pile 100 to first size.

The plurality of tensile members 140 are installed on the manufactured thumb pile 100 and then tensioned to a first size. Here, the first size may be, for example, a size of 5 tons.

3. Step of forming drill hole (H) by excavating ground (G) to predetermined diameter and depth.

Thereafter, the ground G is excavated to a predetermined diameter and depth to form a drill hole H.

4. Step of inserting thumb pile (100) with prestress introduced into drill hole (H)

Thereafter, the thumb pile 100 to which prestress is introduced is inserted into the drill hole H. Here, the thumb pile 100 is inserted so that the first flange 104*a* faces a rear surface of the excavation.

5. Step of tensioning plurality of tensile members (140) to second size while thumb pile (100) is restricted by water compaction or soil.

The thumb pile 100 is restricted by compacting the excavated soil with water and filling an upper portion of the excavated soil with soil. Thereafter, the plurality of tensile members 140 are tensioned to the second size using a hydraulic cylinder. Here, the second size is larger than the first size and may be, for example, a size of 50 tons.

Although the present invention has been described in detail through representative examples above, those of ordinary skill in the art to which the present invention pertains will understand that various modifications can be made to the above-described embodiments without departing from the scope of the present invention. Therefore, the scope of this disclosure is defined not by the detailed description of the invention but by the appended claims, and all differences within the scope will be construed as being included in the present invention.

What is claimed is:

1. A thumb pile provided with a fitting bracket, the thumb pile comprising:

a beam member constituted by a web and a first flange and a second flange, which are perpendicularly coupled to the web on both sides of the web;

an upper bracket fitted into the first flange at an upper portion of the beam member;

a lower bracket that faces the upper bracket at a lower portion of the beam member and is fitted into the first flange; and a plurality of tensile members extending in a longitudinal direction of the beam member between the upper bracket and the lower bracket and fixedly installed on the upper bracket and the lower bracket, respectively, wherein the upper bracket is constituted by a first bracket member and a second bracket member, which face each other with respect to the web at the upper portion of the first flange and are spaced a predetermined distance from each other, each of the first bracket member and the second bracket member comprises:

a vertical plate extending from a front surface of the first flange by a predetermined length in the longitudinal direction of the beam member;

a horizontal plate formed by being bent vertically from one end of the vertical plate; and a hanging plate disposed on a rear surface of the first flange by being vertically bent from one end of the horizontal plate, a first groove is defined at an edge of the other end of the horizontal plate of the first bracket member, a second groove is defined at an edge of the other end of the horizontal plate of the second bracket member, the first groove and the second groove are disposed to face each other to define a hollow having a predetermined size, at which the plurality of tensile members pass, between an inner surface of the first groove and an inner surface of the second groove, and an anchoring member for anchoring the plurality of tensile members is seated on an upper portion of the horizontal plate corresponding to the hollow.

2. The thumb pile of claim 1, wherein the other end of the horizontal plate is provided to protrude by a predetermined length in a direction vertically away from the front surface of the first flange and has a curvature having a shape in which a protruding length from the front surface of the first flange to the other end of the horizontal plate becomes smaller as it goes from a central portion of the first flange to the outside of the first flange.

3. The thumb pile of claim 2, wherein the first groove and the second groove are defined in the edge of the other end of the horizontal plate having the longest protruding length.

4. The thumb pile of claim 3, wherein a reinforcing member vertically protruding from the vertical plate toward the other end of the horizontal plate to support the other end of the horizontal plate is provided at a lower portion of the other end of the horizontal plate, and a protruding length of the reinforcing member vertically protruding from the vertical plate becomes smaller as the reinforcing member moves away from the horizontal plate.

5. The thumb pile of claim 1, wherein a distance between the first bracket member and the second bracket member is equal to or greater than a thickness of a web so as not to interfere with the web when the first bracket member and the second bracket member are fitted into the first flange.

6. The thumb pile of claim 5, wherein a connection member having a bar shape to fix the first bracket member and the second bracket member to each other is provided between the first bracket member and the second bracket member.

7. The thumb pile of claim 1, wherein the anchoring member is seated on the upper portion of the horizontal plate while covering the hollow and has a plurality of anchoring holes through which the plurality of tensile members pass to be anchored.

8. The thumb pile of claim 1, wherein the lower bracket is constituted by a first bracket member and a second bracket member, which face each other with respect to the web at the lower portion of the first flange and are spaced a predetermined distance from each other, each of the first bracket member and the second bracket member comprises:

a vertical plate extending from a front of the first flange by a predetermined length in the longitudinal direction of the beam member;

a horizontal plate formed by being bent vertically from one end of the vertical plate; and a hanging plate disposed on a rear surface of the first flange by being vertically bent from one end of the horizontal plate, and a plurality of through-holes through which the plurality of tensile members pass are defined to be spaced a predetermined interval from each other in the horizontal plate.

9. The thumb pile of claim 8, wherein a separation prevention member that supports the plurality of tensile members to prevent the plurality of tensile members from being separated to the outside of the lower bracket is provided in plurality to be parallel to the plurality of tensile members outside of the horizontal plate, and the plurality of separation prevention members are adjacent to the plurality of through-holes and are provided perpendicular to the horizontal plate.

10. A method for constructing a structure for a temporary earth retaining by using the thumb pile of claim 1, the method comprising:

manufacturing a thumb pile;

tensioning a plurality of tensile members installed on the thumb pile to a first size;

forming a drill hole by excavating ground to a predetermined diameter and depth;

inserting the thumb pile with prestress introduced into the drill hole; and tensioning the plurality of tensile members to a second size greater than the first size while the thumb pile is restricted by water compaction or soil.

* * * * *